United States Patent [19]

Holland et al.

[11] 4,420,208

[45] Dec. 13, 1983

[54] PANEL MOUNTED CONNECTOR

[76] Inventors: Gary W. Holland; Robert H. Holland, both of P. O. Box 1761, Decatur, Ala. 35602

[21] Appl. No.: 254,398

[22] Filed: Apr. 15, 1981

[51] Int. Cl.[3] ..... H01R 13/44

[52] U.S. Cl. ..... 339/88 R; 339/113 R; 339/126 R

[58] Field of Search ..... 339/36, 37, 39, 88, 339/154, 156, 126 R, 113 B, 113 R, 113 L

[56] References Cited

U.S. PATENT DOCUMENTS

| | | | |
|---|---|---|---|
| 2,729,800 | 1/1956 | Knudsen | 339/88 C |
| 2,857,583 | 10/1958 | Markley et al. | 339/113 B |
| 2,878,587 | 3/1959 | Jubenville | 339/126 R |
| 3,199,068 | 8/1965 | Neenan | 339/113 B |
| 3,803,532 | 4/1974 | Taxon | 339/88 R |
| 4,006,959 | 2/1977 | Hopkins et al. | 339/119 R |

FOREIGN PATENT DOCUMENTS

| | | | |
|---|---|---|---|
| 815135 | 6/1959 | United Kingdom | 339/126 J |

*Primary Examiner*—John McQuade
*Assistant Examiner*—Paula Austin
*Attorney, Agent, or Firm*—Harvey B. Jacobson

[57] ABSTRACT

A Central Processing Unit (CPU) may be conveniently and selectively connected to a plurality of Cathode Ray Tube (CRT) terminals through the use of a connection station provided with adapter jacks for interconnecting the CPU and CRT operating cables. The connection station includes an insulated panel in which the adapters are positioned and an enclosure in which the insulated panel may be retained. The insulated adapter panel is preferably made out of a three layer phenolic board so that appropriate identification can be conventionally engraved on the board, and the insulated construction of the board prevents electrical interference between separately connected cables. The connection station permits remote connection of CRT terminals to the CPU without the necessity of running long cables back to the CPU which might be located at a considerable distance from the terminals.

9 Claims, 5 Drawing Figures

PANEL MOUNTED CONNECTOR

BACKGROUND OF THE INVENTION

1. Field of the Invention

The present invention relates generally to electrical connector assemblies and the protective enclosures associated therewith, and more particularly pertains to a unique cable bridging adapter station for operably connecting CPU and CRT control cables.

2. Description of the Prior Art

Mounting devices for electrical connectors, such as might be used to interconnect various control cables, are generally well-known in the art. In this respect, various adapter and connector systems have been developed and generally, each of the systems have to be specially designed to facilitate a particular use and type of connection requirement. For example, U.S. Pat. No. 4,215,236, issued to Reiser on July 29, 1980, discloses a specially designed junction box for electrocardiographic leads. The junction box uses a T-shaped housing formed of a separable halves and containing metal plates, while the electrocardiographic leads are mounted along the periphery of the metal plates. The junction box is then connected to a multi-conductor cable and to the associated electrocardiograph. Accordingly, the Reiser junction box performs a specific function and cannot be utilized for purposes other than those disclosed.

By the same token, U.S. Pat. No. 4,227,764, issued to Fiske on Oct. 14, 1980, discloses a specially designed connector and adapter system for facilitating the field installation of telephone sets by the utilization of easily installable modularized system components. In this respect, the Fiske system utilizes a pair of connectors electrically coupled back-to-back and mechanically secured in this relationship by a protective support medium, such as epoxy and bolts. The connector assembly is contained in a protective enclosure which includes a mounting plate having predetermined arrays of mounting points for enabling securance of the connector assemblies therein. A running cable bridging adaptor system also disclosed in Fiske utilizes a plurality of the connector assemblies as modular units for connecting plural wire subsets of a set of wires of an electrical input cable to preselected wires of a series of output cables. As with the Reiser connection means, the Fiske system is designed for a special purpose and use, and is not readily adaptable for facilitating a connection of electrical or control leads associated with devices other than telephones.

There has been at least one attempt to develop a connection means for facilitating an interconnection of computer leads. In this regard, U.S. Pat. No. 3,308,347, issued to Klaiber on Mar. 7, 1967, discloses a computer patch bay formed from a plurality of base blocks. The Klaiber apparatus is designed to substantially reduce the use of plug-in interconnections of patch cords associated with computers and, in so doing, utilizes multicavity base blocks each of which has one longitudinal wall formed across one longitudinal edge, while the other longitudinal edge is unwalled or open. At least one longitudinal divider is formed between the longitudinal edges of a block and in addition, each of the base blocks is provided with a transverse wall formed across each transverse edge of the block, with transverse dividers being formed therebetween. Spring contact assemblies may then be secured within the recesses, and the patch bay construction is obtained by disposing the base blocks adjacent to each other. In this manner, the contact assemblies are each electrically shielded and mechanically protected, and the assemblies in differing base blocks are exactly aligned, one with the other, and also with respect to the patch cord tips in a prepatch panel associated therewith. Accordingly, it can be appreciated that the Klaiber patch bay is complex in its construction and further, it is costly to construct and install.

As such, there exist a continuing need for improved CPU and CRT control cable junction boxes which are simple in design, which can be economically manufactured, and which can be easily installed. In this connection, the present invention substantially fulfills this need.

SUMMARY OF THE INVENTION

The general purpose of the present invention, which will be described subsequently in greater detail, is to provide a new and improved CPU and CRT control cable connection junction box which has all the advantages of the prior art junction boxes and none of the disadvantages. To attain this, a protective enclosure is provided in which a plurality of connection panels may be located. The connection panels include a bracket portion which is mountable to a back panel of the protective enclosure, such bracket serving to retain the connection panels in an orthogonal relationship to the back panel. The connection panels are provided with a plurality of ports or apertures in which cable connection adapters may be mounted, and the connection panel is formed of a phenolic or other insulating material so as to prevent signal interference between respective adjacently-located cable adapters. CPU cables may then be connected to the adapters on one side of the connection panels, while CRT cables may be connected to the other side of the adapters so as to establish signal communication therebetween, and the connection panel may be appropriately engraved, especially when a three layer phenolic board is utilized, to facilitate the proper locating of the respective CPU and CRT cables. The invention may be located on different floors of a dwelling, or even in different dwellings, remote from the CPU location, thereby eliminating the need for directing long cables from a CRT unit to the CPU.

It is therefore an object of the present invention to provide an improved cable connection device that has all the advantages of similarly employed prior art cable connection devices and none of the disadvantages.

It is another object of the present invention to provide an improved cable connection device which may be easily and economically manufactured.

It is a further object of the present invention to provide an improved cable connection device which is both simple in construction and limited in the number of moving parts.

Still another object of the present invention is to provide an improved cable connection device which may be quickly and easily installed in a given location.

Yet another object of the present invention is to provide an improved cable connection device which is reliable and durable in its construction.

Even another object of the present invention is to provide an improved cable connection device which lowers the cost and increases the flexibility of computer cable systems.

A still further object of the present invention is to provide an improved cable connection device which facilitates a quick and reliable interchange of control cables between CRT terminals and a central processing unit.

An even further object of the present invention is to provide an improved cable connection device which facilitates computer cable maintenance by permitting easy operability checks to be made thereon.

Yet still another object of the present invention is to provide an improved cable connection device which custom identifies computer cables associated therewith.

Still even another object of the present invention is to provide an improved cable connection device operating as a central location for swapping and interconnecting computer cables.

Yet another object of the present invention is to provide an improved computer connection system which will provide industry with the opportunity to organize and utilize a systematic method of cable installation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
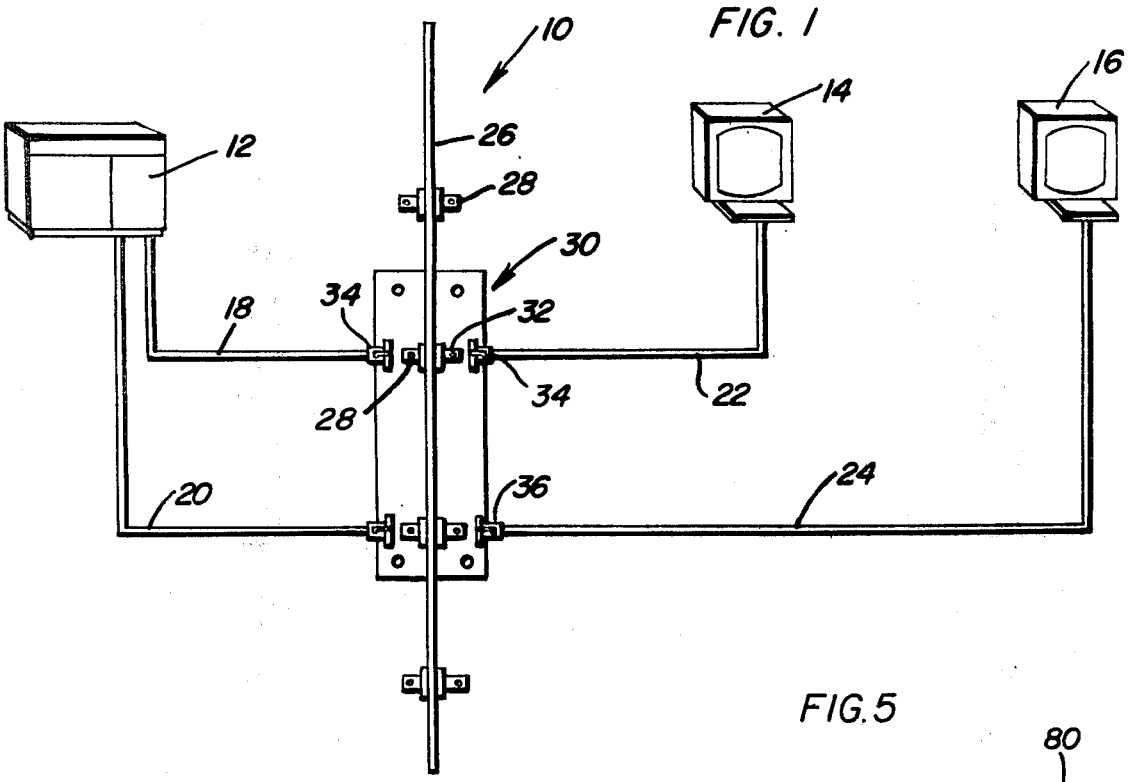
FIG. 1 is a pictorial illustration of the connection device forming the present invention operably associated with a central processing unit and a plurality of CRT terminals.

With reference now to the drawings and in particular to FIG. 1 thereof, an improved computer cable connection device embodying the principles and concepts of the present invention and generally designated by the reference numeral 10 will be described. Specifically, it can be seen that the cable connection device 10 may be operably utilized to facilitate an interconnection of a central processing unit (CPU) 12 to a plurality of cathode ray tube (CRT) terminals, only two of such terminals 14, 16 being illustrated for purposes of example. In this regard, the CPU 12 may be provided with any number of signal delivery cables 18, 20 which are designed for respective connection to the CRT terminals 14, 16, thereby to facilitate signal delivery and receipt between the CPU and the terminals. As shown, the CRT terminal 14 may be provided with a control cable 22, while the CRT terminal 16 may be similarly provided with a control cable 24, the cables 22, 24 then being respectively connectible to the signal cables 18, 20 so as to provide the aforementioned signal delivery and receipt.

To provide the desired connection between the cables 18, 22 and 20, 24, the present invention 10 employs a connection panel 26 provided with a plurality of through-extending cable connection adapters 28, while the connection panel per se may be fixedly attached to and retained by a wall mounting bracket 30. As can be appreciated, the commercially available adapters 28 serve as jacks to establish signal communication between the cables 18, 22 and 20, 24. In this regard, the adapters 28 are of a generally cylindrical construction and have connection pins 32 extending radially outwardly therefrom. By the same token, the cables 18, 20, 22, 24 are provided with connection ends 34, such connection ends being of a hollow cylindrical construction and being insertable over the adapters 28 thereby to establish a signal communicating connection therewith. Additionally, the connection ends 34 are provided with longitudinally extending L-shaped slots 36, such slots serving to receive the laterally extending pins 32 during an insertion of the adapters 28 into the connection ends 34, and once the laterally extending pins have traversed the length of a first leg of the L-shaped slots 36, a simple twist may be provided to effect a locking and securing action between the adapters 28 and the respective cables 18, 20, 22 and 24. As can be further ascertained with reference to FIG. 1, the adapters 28 are provided with two pairs of laterally extending pins 32, one pair being located at each of the ends of a respective adapter, whereby two cables 18, 22 or 20, 24 may be respectively attached thereto to establish the afore-described signal communication between the CPU 12 and the respective CRT terminals 14, 16.

Figure 2:
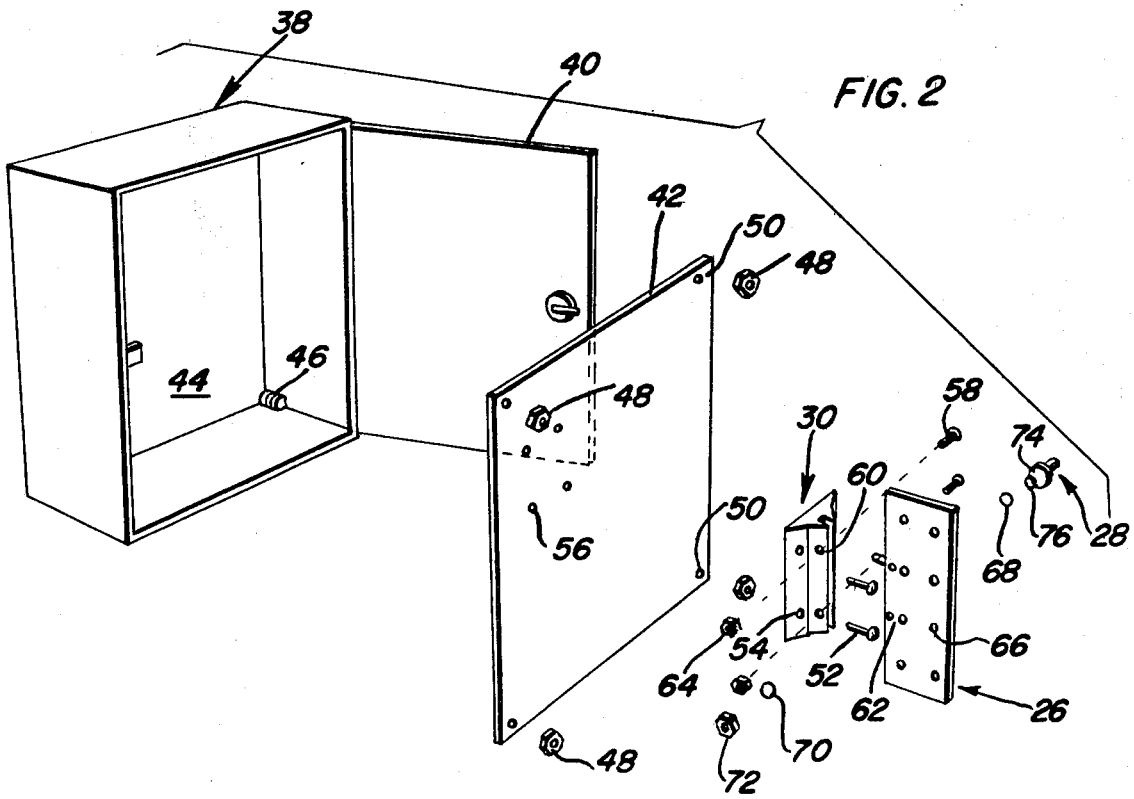
FIG. 2 is an exploded perspective view of the cable connection device forming the present invention.

With reference now to FIG. 2 of the drawings, it can be seen that the cable connection device 10 forming the present invention may also include the use of a protective enclosure 38 in which the bracket 30 and associated connection panel 26 may be operably installed. In this connection, the protective enclosure 38 may be of a rectangular construction having a front mounted, hingedly connected door 40 and a rearwardly-located mounting panel 42. The mounting panel 42 may be removably attached to a back wall 44 associated with the protective enclosure 38 so as to facilitate its removal as desired during such periods of time when it is desired to attach or remove one or more of the mounting brackets 30. Any conventional means of attachment may be utilized to secure the mounting panel 42 to the back wall 44, such as fixedly secured mounting bolts 46 extending through the back wall 44 and being threadably connectible to nuts 48 after the bolts have been directed through apertures 50 formed in the mounting panel per se.

With respect to the manner of attachment of the mounting bracket 30 to the mounting panel 42, any conventional attachment means may be employed, such as the use of pan head machine screws 52 directable through a plurality of apertures 54 contained in the bracket 30 and being further threadably engageable with threaded apertures 56 operably positioned in the mounting panel 42. As clearly illustrated in FIG. 2, the mounting bracket 30 may be selectively positioned on the mounting panel 42 in a manner whereby a plurality of such mounting brackets may be attached thereto. This of course increases the number of adapters 28 which may be utilized within one protective enclosure 38, thereby to increase the number of CRT terminals connectible to a central processing unit 12.

As to the manner of securing the connection board 26 to a mounting bracket 30, it is again envisioned that any conventional attachment means might be employed, such as the use of pan head machine screws 58 which are concurrently threadably secureable through apertures 60, as contained in a wall bracket 30, and 62, as contained in the connection panel 26. Machine thread cap nuts 64 may then be attached to the machine screws 58 to facilitate the securement of the connection panel 26 to a wall bracket 30, while at the same time providing for a quick and easy disassembly therebetween if necessitated. FIG. 2 further illustrates the fact that the connection panel 26 may be provided with a plurality of ports or apertures 66 into which the adapters 28 may be operably installed. In this respect, an adapter 28 is centrally positionable within one of the respective apertures 66, and its assembly includes the use of an insulating washer 68, a lock washer 70, and a hex head lock nut 72. In this regard, the adapter 28 is provided with a lip portion 74 abuttable against one surface of the connection panel 26, with the insulating washer 68 serving to insulate the lip portion from the panel, and a threaded end portion 76 then projects through the associated aperture 66 to the opposed side of the board. The lock washer 70 may then be concentrically positioned thereover, such lock washer being provided with gripping teeth for effecting a secure engagement with the connection panel 26, and the lock nut 72 may then be threadably positioned onto the adapter 28 so as to effect a secure engagement thereof with the panel.

Figure 5:
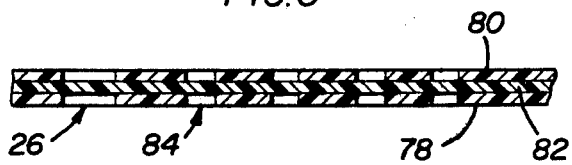
FIG. 5 is an enlarged partial sectional view taken substantially through a plane indicated by section line 5—5 in FIG. 3.
Figure 4:
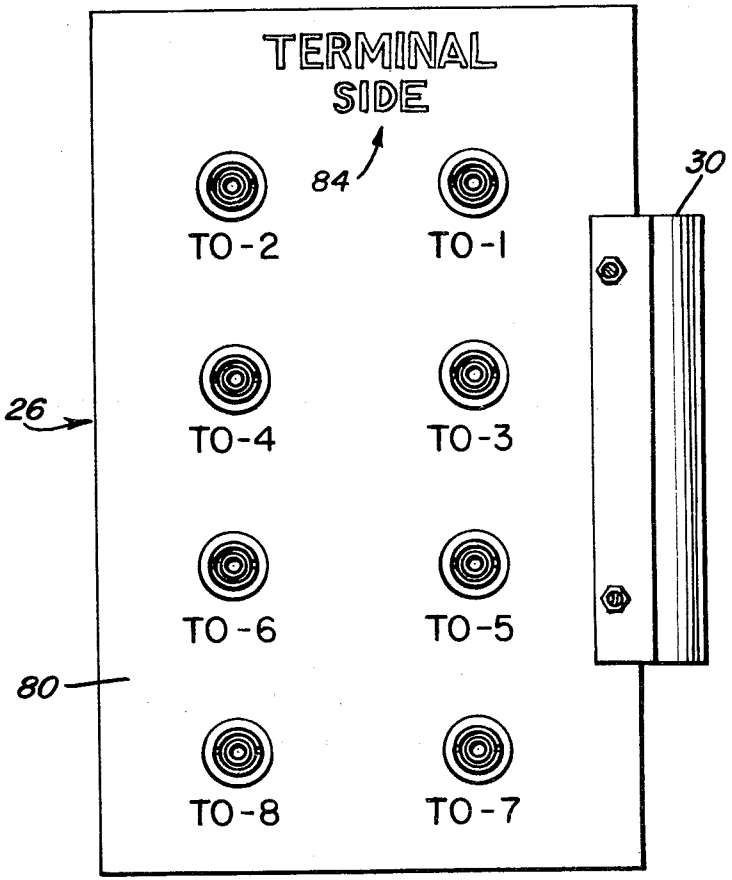
FIG. 4 is a plan view illustrating a second side of a connection panel forming a part of the present invention.
Figure 3:
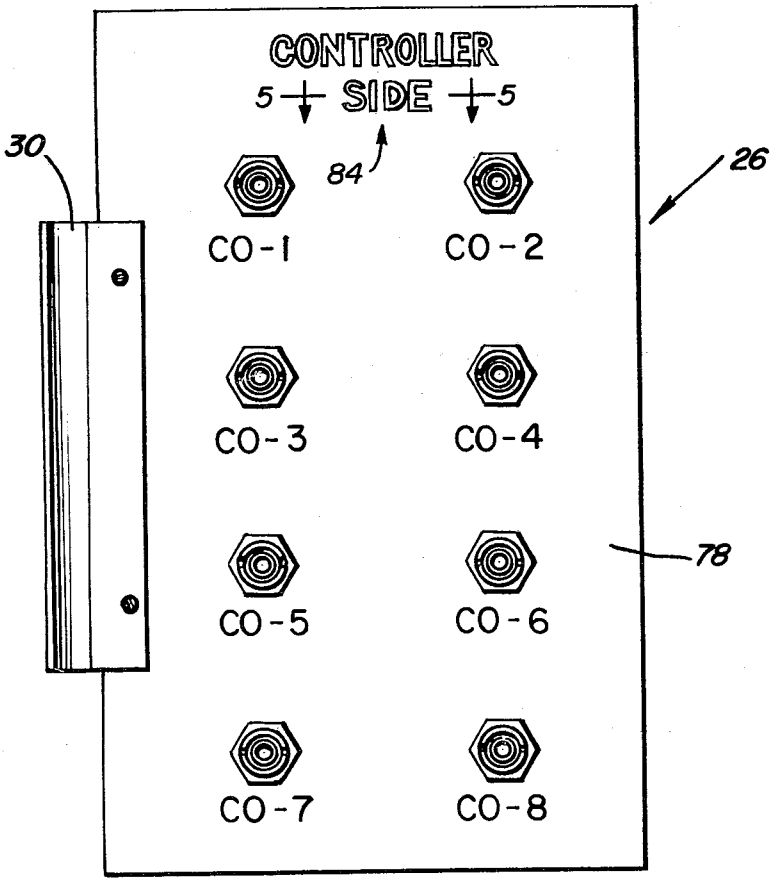
FIG. 3 is a plan view illustrating a first side of a connection panel associated with the present invention.

FIGS. 3, 4 and 5 have been provided to illustrate more specific constructional details of the connection panel 26. Specifically, FIG. 3 illustrates a first face or side 78 of the connection panel 26, while FIG. 4 illustrates the opposed or second side 80 of the connection panel. Inasmuch as the connection panel 26 would normally be constructed from three layer phenolic board as shown in FIG. 5. FIGS. 3 and 4 further illustrate the manner in which appropriate identification indicia 84 may be provided. In this regard, the three layer board would desirably be of the black, white and black construction, so that the appropriate words, letters and numbers engraved on each of the faces of the outside layers 78, 80 would expose the white contrasting surfaces of inner layer 82 against a black background presented by the faces 78 and 80 of the outside layers. More particularly, FIG. 3 illustrates the fact that the side 78 may be identified as the CONTROLLER SIDE, thus to indicate that the CPU control cables 18, 20 should be connected thereto. By the same token, FIG. 4 illustrates the fact that side 80 may be used as the TERMINAL SIDE to thus indicate that the CRT terminal cables 22, 24 should be connected thereto. Additionally, appropriate identification of the respective adapters 28 may be provided so as to facilitate a proper interconnection between the CPU and CRT signal providing cables.

As such, a computer cable connection device has been described which should make computer cable systems more flexible and less cost inhibiting to install and change. The uniqueness of the present invention is apparent in that it is available for a number of different uses. Typically, the connection panels would need to be only 5" wide by 8" long, so as to present a compact size thus to enable a user to install the device in relatively small areas. With the feature of engraving being available on the three layer phenolic material of the connection panel 26, the boards may be custom identified to suit the needs of each user. For example, it may be desired to use one of the connection panels in a seven floor building having CRT terminals on each floor with only one CPU being utilized. With this in mind, each of the cable connecting adapters 28 contained on a connection panel 26 may be identified with a prefix 1 through 7 under a given adapter, depending on the floor of the dwelling which that adapter is servicing. This effectively serves as a permanently engraved port code system which is unique in its own right. By way of another example, the code C7-1 would indicate that the cable is coming from the controller or CPU to the seventh floor of the building, while the actual cable number would be designated as 1. When the connection panel is turned over to the opposite side 80, the adapters 28 will be identified the same way, except for the prefix letter. Specifically, the prefix letter would be changed to a T which means that the adapter and cable on the opposed side 80 are servicing the terminal side of the cable run.

Also, as aforementioned, the phenolic material construction of the connection panel 26 eliminates any electrical conductivity between the adapters, such insulated isolation being critical in cable systems.

In addition to the features above described, the invention as designed makes a computer cable system more flexible by giving a cable installer a central point to swap cables in case of machine breakdown, or to add a machine cable quickly without having to pull a cable all the way back to the CPU, which could be as far as 1,500 feet or more. Further, it enables the computer technician and/or service representative to check cable problems at a central point in the cable system, while the protective housing 38 employed in the invention may be sized to accommodate any number of connection panels 26 along with their attendant mounting brackets 30. As such, a means is provided for enabling industry, schools, and many other commercial operations who utilize CRT and CPU computer systems the opportunity to organize and systematize cable installation for their particular systems.

With respect to the above description, it should be realized that the optimum dimensional relationships for the parts of the invention are deemed readily apparent and obvious to one skilled in the art to which the invention pertains, and all equivalent relationships to those illustrated in the drawings and described in the specification, to include modification of form, size, arrangement of parts and details of operation, are intended to be encompassed by the present invention.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a cable connection assembly having a connection panel provided with opposed external surfaces and cable attachment means mounted on the panel for removably coupling a plurality of cables to each other, said cables extending from the opposed external surfaces of the panel, the improvement residing in said panel being a multi-layered board having an inner layer forming surfaces contrasting with the opposed external surfaces of the panel, and two outside layers on which the opposed external surfaces are formed, said opposed surfaces being engraved to visually expose portions of the contrasting surfaces of the inner layer through the outside layers forming identification indicia for the cables extending from the opposed surfaces of the panel.

2. The combination defined in claim 1 wherein said contrasting surfaces are white and the opposed external surfaces of the outside layers are black.

3. The combination of claim 1 wherein said cable attachment means is fixedly secured to said connection panel and includes cable connection adapter means positioned within through-extending apertures contained in said connection panel so as to present said cable attachment means on the opposed surfaces of said connection panel, whereby at least two cables can be connected to each of said cable connection adapter means to complete said connecting of said cables.

4. The improved cable connection assembly as defined in claim 3, and further including mounting bracket fixedly securable to said connection panel means, said mounting bracket means serving to facilitate a secure positioning of said cable connection assembly in a desired location.

5. The improved cable connecting assembly as defined in claim 4, wherein said cable attachment means include radially extending pins designed for engagement with L-shaped slots associated with connecting end portions of said signal carrying cables.

6. The improved cable connection assembly as defined in claim 5, and further including a protective enclosure in which said connection panel and said cable connection adapter means may be substantially contained.

7. The improvement as defined in claim 1, wherein said panel is made of an electrically nonconductive phenolic.

8. An improved cable connection means for operably connecting signal carrying cables, said cable connection means comprising: connection panel means; cable connection adapter means having cable attachment means on opposed ends thereof and being fixedly secured to said connection panel means, said cable connection adapter means being positioned within through-extending apertures contained in said connection panel means so as to present said cable attachment means on opposed surfaces of said connection panel means, whereby at least two cables can be connected to each of said cable connection adapter means to complete said connecting of said signal carrying cables, mounting bracket means fixedly securable to said connection panel means, said mounting bracket means serving to facilitate a secure positioning of said cable connection means in a desired location, said cable attachment means including radially extending pins designed for engagement with L-shaped slots associated with connecting end portions of said signal carrying cables, said connecting panel means being constructed of an non-electrically conductive material so as to prevent signal interference between adjacent cable connection adapter means, a protective enclosure in which said connection panel means and said cable connection adapter means may be substantially contained, said protective enclosure including a back wall and a mounting panel removably attachable to said back wall, said mounting bracket means being removably attachable to said mounting panel, said non-electrically conductive material being phenolic, said connection panel means being of a three layer construction formed from said phenolic, said three layer construction including a top black colored layer, a middle white colored layer, and a bottom black colored layer, so as to permit selective engraving on said connection panel means for customized identification purposes, said engraving then presenting white colored letters and numerals against a black background.

9. The improved cable connection means for operably connecting signal carrying cables as defined in claim 8, wherein said signal carrying cables are respectively utilized to operably connect one or more central processing units to one or more cathode ray tube terminals.

* * * * *